US006089667A

United States Patent [19]

Hobbs

[11] Patent Number: 6,089,667

[45] Date of Patent: Jul. 18, 2000

[54] ADJUSTABLE SUPPORT

[76] Inventor: Peter L. Hobbs, 119 Brighton Road, Purley, Surrey CR8 4HE, United Kingdom

[21] Appl. No.: 09/074,162

[22] Filed: May 7, 1998

[51] Int. Cl.[7] ..... A47C 16/00

[52] U.S. Cl. ..... 297/423.12; 297/423.45; 108/150; 248/188.2; 248/157

[58] Field of Search ..... 297/423.11, 423.12, 297/423.39, 423.45, 423.41, 423.44; 108/147, 180; 248/404, 405, 161, 157, 188.2

[56] References Cited

U.S. PATENT DOCUMENTS 4,564,237 1/1986 Steifensand ..... 297/423.11
4,635,565 1/1987 Novak ..... 108/147 X
4,655,426 4/1987 Von Dulong et al. ..... 248/405
5,149,174 9/1992 Charash ..... 297/423.12
5,255,957 10/1993 Opsvik et al. ..... 297/423.12
5,330,254 7/1994 Larson ..... 297/423.12 X

*Primary Examiner*—Anthony D. Barfield

[57] ABSTRACT

An apparatus is provided including a knee support assembly having a rigid plate with a pad mounted thereon. Also included is a base mounted on a bottom of the knee support assembly such that the knee support assembly forms an angle with the base which is less than 90 degrees.

2 Claims, 2 Drawing Sheets

ADJUSTABLE SUPPORT

BACKGROUND OF THE INVENTION

1. Field of the Invention

The present invention relates to adjustable chairs and more particularly pertains to a new adjustable support for supporting a kneeling person.

2. Description of the Prior Art

The use of adjustable chairs is known in the prior art. More specifically, adjustable chairs heretofore devised and utilized are known to consist basically of familiar, expected and obvious structural configurations, notwithstanding the myriad of designs encompassed by the crowded prior art which have been developed for the fulfillment of countless objectives and requirements.

Known prior art adjustable chairs include U.S. Pat. No. 4,589,699; U.S. Pat. No. 4,632,458; U.S. Pat. No. 5,299,771; U.S. Pat. No. 3,182,947; U.S. Pat. No. 2,375,696; and Foreign Patents WO 93/08717 and WO 97/06714.

In these respects, the adjustable support according to the present invention substantially departs from the conventional concepts and designs of the prior art, and in so doing provides an apparatus primarily developed for the purpose of supporting a kneeling person.

SUMMARY OF THE INVENTION

In view of the foregoing disadvantages inherent in the known types of adjustable chairs now present in the prior art, the present invention provides a new adjustable support construction wherein the same can be utilized for supporting a kneeling person.

The general purpose of the present invention, which will be described subsequently in greater detail, is to provide a new adjustable support apparatus and method which has many of the advantages of the adjustable chairs mentioned heretofore and many novel features that result in a new adjustable support which is not anticipated, rendered obvious, suggested, or even implied by any of the prior art adjustable chairs, either alone or in any combination thereof.

To attain this, the present invention generally comprises a knee support assembly including a plate with a generally rectangular configuration. The plate has a planar top face, a bottom face and a periphery defined by a pair of rounded front corners and a pair of rear right angle corners. A pad is mounted on the top face of the plate with a periphery of a size and shape similar to that of the plate. The knee support assembly further includes a sleeve having a top end integrally coupled to a center of the bottom face of the plate. The sleeve extends downwardly from the plate along an axis which intersects the plane at an 80 degree angle. Next provided is a base with a top for slidably receiving the sleeve of the knee support assembly. The sleeve and the top of the base have at least one rectilinear surface for precluding the rotation of the knee support assembly with respect to the base. Situated within the base is a gear assembly including a pair of vertically spaced supports mounted within the base. Note FIG. 6. For reasons that with soon become apparent, a pair of vertically aligned apertures are formed in the supports. A threaded post is situated within the apertures of the supports. A top end of the threaded post is rotatably mounted to the knee support assembly. Further, the threaded post is slidably situated within the top of the base and the sleeve of the knee support assembly. The gear assembly further includes a cylinder rotatably positioned between the supports. A threaded bore is formed in the cylinder for screwably engaging the threaded post. Also, an outer surface of the cylinder is equipped with gear teeth formed therein. A dual gear assembly is provided including a rod rotatably coupled within the base. A central extent of the dual gear assembly has a worm gear mounted thereon in engagement with the outer surface of the cylinder. At least one end of the dual gear assembly has straight gear teeth formed therein. With reference to FIGS. 5 & 6, the gear assembly also has a drive gear with a diameter which is greater than that of the rod of the dual gear assembly. A plurality of gear teeth are formed along a periphery of the drive gear for engagement with the straight gear teeth of the dual gear assembly. Such engagement effects the rotation of the dual gear assembly which in turn rotates the cylinder. As a result, the threaded post and knee support assembly may be raised and lowered. Finally, a hand crank or motor is provided for rotating the drive gear.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable support apparatus and method which has many of the advantages of the adjustable chairs mentioned heretofore and many novel features that result in a new adjustable support which is not anticipated, rendered obvious, suggested, or even implied by any of the prior art adjustable chairs, either alone or in any combination thereof.

It is another object of the present invention to provide a new adjustable support which may be easily and efficiently manufactured and marketed.

It is a further object of the present invention to provide a new adjustable support which is of a durable and reliable construction.

An even further object of the present invention is to provide a new adjustable support which is susceptible of a low cost of manufacture with regard to both materials and labor, and which accordingly is then susceptible of low prices of sale to the consuming public, thereby making such adjustable support economically available to the buying public.

Still yet another object of the present invention is to provide a new adjustable support which provides in the apparatuses and methods of the prior art some of the advantages thereof, while simultaneously overcoming some of the disadvantages normally associated therewith.

Still another object of the present invention is to provide a new adjustable support for supporting a kneeling person.

Even still another object of the present invention is to provide a new apparatus that includes a knee support assembly having a rigid plate with a pad mounted thereon. Also included is a base mounted on a bottom of the knee support assembly such that the knee support assembly forms an angle with the base which is less than 90 degrees.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
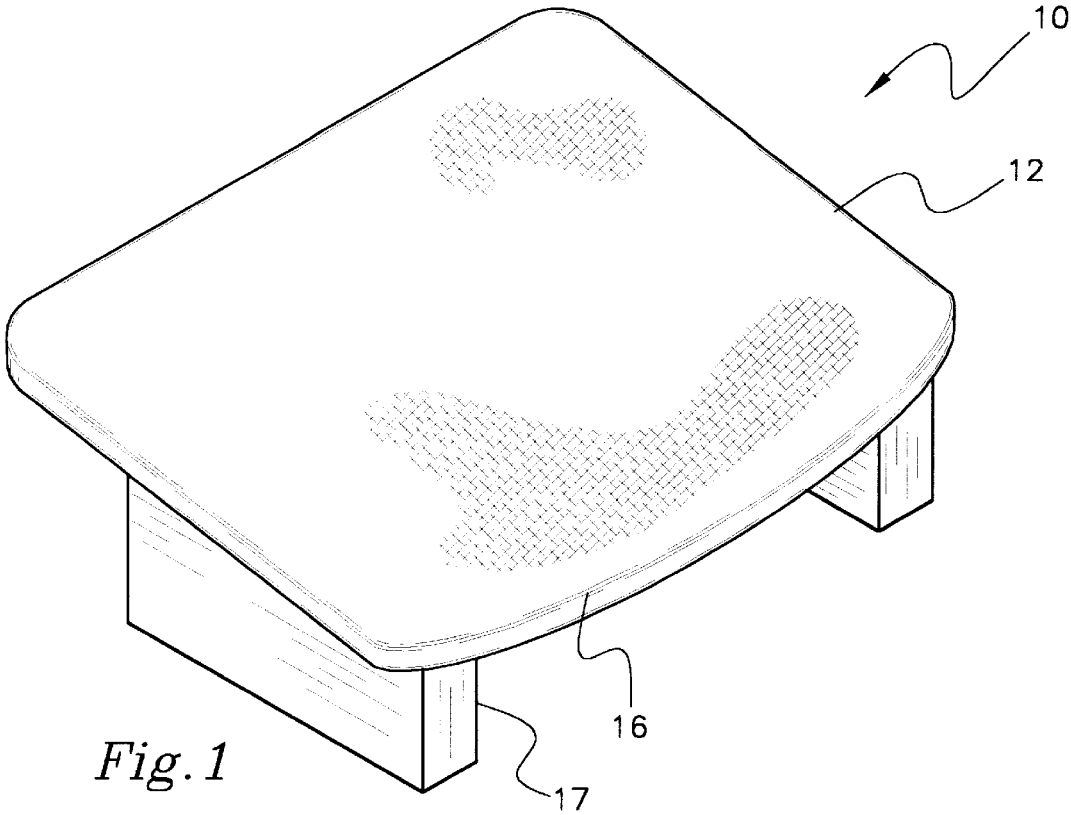
FIG. 1 is a perspective view of a simplified embodiment of the present invention.

With reference now to the drawings, and in particular to FIGS. 1 through 8 thereof, a new adjustable support embodying the principles and concepts of the present invention and generally designated by the reference numeral 10 will be described.

The present invention, designated as numeral 10, includes a knee support assembly 12 including a plate 14 with a generally rectangular configuration. The plate has a planar top face, a bottom face and a periphery defined by a pair of front rounded corners and a pair of rear right angle corners. A pad 16 is mounted on the top face of the plate with a periphery of a size and shape similar to that of the plate.

Figure 2:
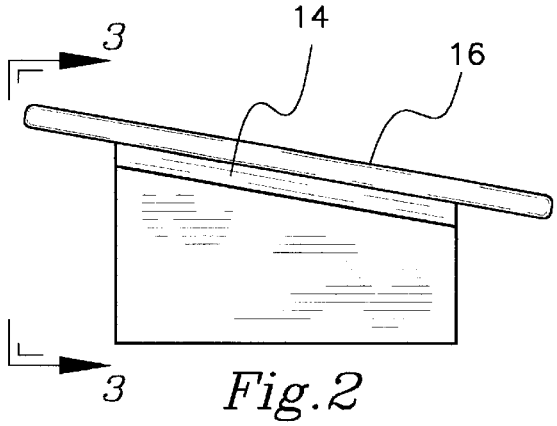
FIG. 2 is a side view of the embodiment of the present invention shown in FIG. 1.
Figure 3:
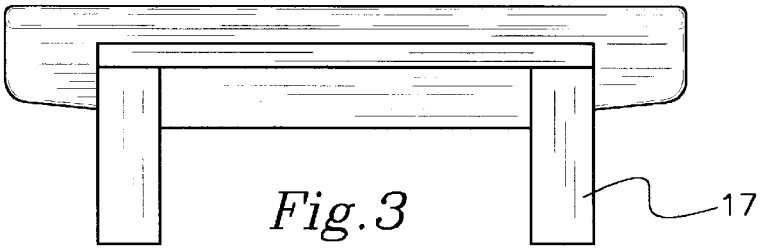
FIG. 3 is a front view of the embodiment of the present invention shown in FIGS. 1 & 2.

In a first embodiment, the knee support assembly includes a base comprising a pair of rectangular legs 17 each having a beveled upper surface. As shown in FIGS. 1–3, the legs maintain the knee support assembly fixed at an angle for supporting a kneeling user thereon.

With reference now to the remaining embodiments of the present invention shown in FIGS. 4–8, the knee support assembly further includes a sleeve 18 with a rectangular configuration having a top end integrally coupled to a center of the bottom face of the plate. As shown in FIGS. 4–8, the sleeve extends downwardly from the plate along an axis which intersects the plane at an approximate 80 degree angle.

Next provided is a base 20 with a top for slidably receiving the sleeve of the knee support assembly. The sleeve and the top of the base preclude the rotation of the knee support assembly with respect to the base. As shown in FIGS. 4–8, the base preferably has a length equal to that of the knee support assembly and a width less than ¼ that of the knee support assembly. For providing additional stability, a bottom of the base is preferably widened with respect to the remaining portion of the base.

Situated within the base is a gear assembly including a pair of vertically spaced supports 22 fixedly mounted within the base. Note FIG. 6. For reasons that with soon become apparent, a pair of vertically aligned apertures 24 are formed in the supports. A threaded post 26 is situated within the apertures of the supports. A top end of the threaded post is rotatably mounted to the knee support assembly. Further, the threaded post is slidably situated within the top of the base and the sleeve of the knee support assembly.

The gear assembly further includes a cylinder 30 rotatably positioned between the supports. It is imperative that the cylinder have an outer diameter greater than that of the apertures of the supports. A threaded bore 32 is formed in the cylinder for screwably engaging the threaded post. Also, an outer surface of the cylinder is equipped with gear teeth 34. A dual gear assembly 36 is provided including a rod 38 rotatably coupled within the base. A central extent of the dual gear assembly has a worm gear 40 mounted thereon which remains in engagement with the outer surface of the cylinder. At least one end of the dual gear assembly has a small gear with straight gear teeth 42 formed therein.

Figure 5:
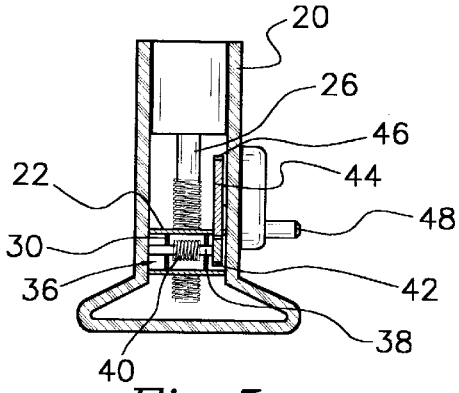
FIG. 5 is a cross-sectional view of the present invention take along line 5—5 shown in FIG. 4.
Figure 6:
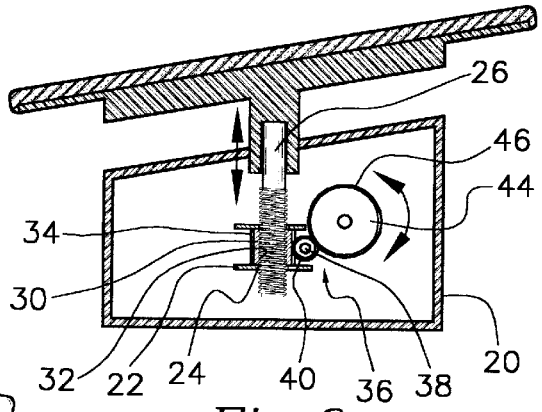
FIG. 6 is a cross-sectional view of the present invention taken along line 6—6 shown in FIG. 5.
Figure 7:
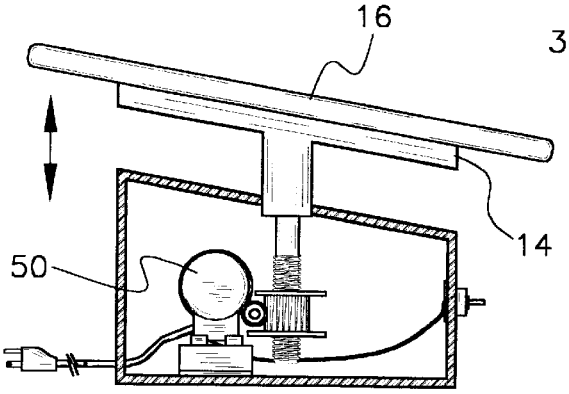
FIG. 7 is a side cross-sectional view of another embodiment of the present invention.
Figure 8:
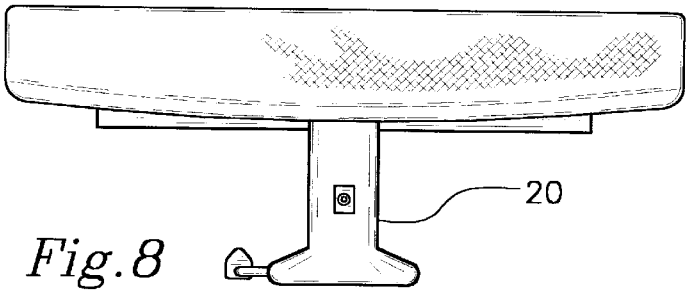
FIG. 8 is a rear view of the embodiment of the present invention shown in FIG. 7.

With reference to FIGS. 5 & 6, the gear assembly also has a large drive gear 44 rotatably coupled within the base with a diameter which is greater than that of the small gear of the dual gear assembly. A plurality of gear teeth 46 are formed along a periphery of the drive gear for engagement with the straight gear teeth of the dual gear assembly. Such engagement effects the rotation of the dual gear assembly which in turn rotates the cylinder. As a result, the threaded post and knee support assembly may be raised and lowered. It should be noted that the combination of gears set forth hereinabove is critical in preventing a weight of a user situated on the knee support assembly from rotating the threaded post and inadvertently lowering. In an unillustrated simplified alternate embodiment, a pair of beveled gears may be employed in lieu of the combination of gears set forth hereinabove.

Figure 4:
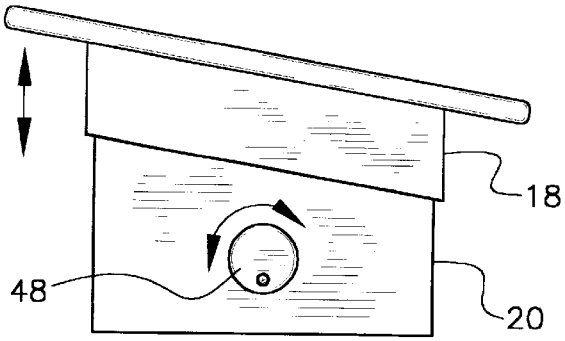
FIG. 4 is a side view of another embodiment of the present invention.

Finally, a hand crank 48 may be included for manually rotating the drive gear, as shown in FIGS. 4–6. In the alternative, a battery operated motor 50 may be provided for similar purposes. Note FIGS. 7 & 8. A switch is preferably mounted on the base for controlling the motor.

As an option, the knee support assembly may be pivotally coupled to the threaded post about a horizontal axis. As such, the knee support may be tilted with respect to the base. As a further option, the aforementioned motor may be utilized to afford the automatic tilting of the knee assembly about the horizontal axis by way of a dedicated switch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A knee support comprising, in combination:

a knee support assembly including a plate with a generally rectangular configuration having a planar top face, a bottom face and a periphery defined by a pair of rounded front corners and a pair of rear right angle corners, a pad mounted on the top face of the plate with a periphery of a size and shape similar to that of the plate, and a sleeve having a top end integrally coupled to a center of the bottom face of the plate and a tube member extending downwardly and having a channel with a longitudinal axis which intersects the plane of the plate at approximately an 80 degree angle, the tube member being mounted to a base flange mounted to the bottom face of the plate;

a base comprising a single pedestal base with a top end and a bottom and a perimeter wall extending between the top and bottom, the perimeter wall having relatively narrower end walls and relatively wider side walls extending between the end walls, the bottom having a flared portion formed by lower portions of the side walls being flared outwardly from upper portions of the side walls, the side walls of the flared portion having a maximum width approximately twice a width between the side walls of the upper portions of the side walls, the top having a top aperture for slidably receiving the tube member of the knee support assembly and further precluding the rotation of the knee support assembly with respect to the base;

a gear assembly situated within the base a threaded post extending through the top aperture and having a top end rotatably mounted to the tube member on the knee support assembly and slidably situated within the top aperture of the base and the tube member of the knee support assembly, a rotatable cylinder with a threaded bore formed therein for screwably engaging the threaded post and an outer surface with gear teeth formed therein, a dual gear assembly including a rod rotatably coupled within the base with a central extent having a worm gear mounted thereon in engagement with the outer surface of the cylinder and an end with straight gear teeth formed therein, and a drive gear with a diameter which is greater than that of the rod of the dual gear assembly and a plurality of gear teeth formed along a periphery thereof for engagement with the straight gear teeth of the dual gear assembly for effecting the rotation of the dual gear assembly which in turn rotates the cylinder, thereby raising and lowering the threaded post and knee support assembly;

means for rotating the drive gear, the means comprising a hand crank including a crank disc connected to the drive gear and a crank handle mounted on the crank disc at a position radially spaced from a center of the crank disc.

2. A knee support comprising:

a knee support assembly including a rigid plate with a pad mounted thereon; and a base mounted on a bottom of the knee support assembly the base comprising a single pedestal base with a top end and a bottom and a perimeter wall extending between the top and bottom, the perimeter wall having relatively narrower end walls and relatively wider side walls extending between the end walls, the bottom having a flared portion formed by lower portions of the side walls being flared outwardly from upper portions of the side walls, the side walls of the flared portion having a maximum width approximately twice a width between the side walls of the upper portions of the side walls; and elevation means for selectively elevating the knee support assembly with respect to the base, the elevation means comprising a gear assembly situated within the base a threaded post extending through a top aperture and having a top end rotatable mounted to a tube member on the knee support assembly and slidably situated within the top aperture of the base and the tube member of the knee support assembly, a rotatable cylinder with a threaded bore formed therein for screwably engaging the threaded post and an outer surface with gear teeth formed therein, a dual gear assembly including a rod rotatably coupled within the base with a central extent having a worm gear mounted thereon in engagement with the outer surface of the cylinder and an end with straight gear teeth formed therein, and a drive gear with a diameter which is greater than that of the rod of the dual gear assembly and a plurality of gear teeth formed alone a periphery thereof for engagement with the straight gear teeth of the dual gear assembly for effecting the rotation of the dual gear assembly which in turn rotates the cylinder, thereby raising and lowering the threaded post and knee support assembly;

wherein the elevation means is manually operated, wherein the elevation means comprises a hand crank including a crank disc connected to the drive gear and a crank handle mounted on the crank disc at a position radially spaced from a center of the crank disc.

* * * * *